US010796658B2

(12) United States Patent
Peng et al.

(10) Patent No.: US 10,796,658 B2
(45) Date of Patent: Oct. 6, 2020

(54) GAMMA REFERENCE VOLTAGE GENERATING CIRCUIT, LIQUID CRYSTAL DISPLAY PANEL DRIVING CIRCUIT AND METHOD THEREOF

(71) Applicant: SHENZHEN CHINA STAR OPTOELECTRONICS SEMICONDUCTOR DISPLAY TECHNOLOGY CO., LTD., Shenzhen, Guangdong (CN)

(72) Inventors: Leli Peng, Guangdong (CN); Xue Hu, Guangdong (CN)

(73) Assignee: SHENZHEN CHINA STAR OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 284 days.

(21) Appl. No.: 15/747,487

(22) PCT Filed: Jan. 4, 2018

(86) PCT No.: PCT/CN2018/071383
§ 371 (c)(1),
(2) Date: Jan. 25, 2018

(87) PCT Pub. No.: WO2019/127638
PCT Pub. Date: Jul. 4, 2019

(65) Prior Publication Data

US 2020/0082778 A1 Mar. 12, 2020

(30) Foreign Application Priority Data

Dec. 29, 2017 (CN) ..... 2017 1 1483122

(51) Int. Cl.
*G09G 3/36* (2006.01)

(52) U.S. Cl.
CPC ..... *G09G 3/3688* (2013.01); *G09G 3/3614* (2013.01); *G09G 2310/0289* (2013.01); *G09G 2320/0276* (2013.01)

(58) Field of Classification Search
CPC ..... G09G 3/36; G09G 3/3688; G09G 3/3614
See application file for complete search history.

(56) References Cited

U.S. PATENT DOCUMENTS

2005/0195149 A1* 9/2005 Ito ..... G11C 5/147 345/98
2006/0097969 A1* 5/2006 Tsai ..... G09G 3/20 345/88
2007/0046600 A1* 3/2007 Sun ..... G09G 3/3688 345/89

FOREIGN PATENT DOCUMENTS

CN 102376249 3/2012
CN 107452354 12/2017

* cited by examiner

*Primary Examiner* — Alexander Eisen
*Assistant Examiner* — Cory A Almeida
(74) *Attorney, Agent, or Firm* — Hemisphere Law, PLLC; Zhigang Ma

(57) ABSTRACT

A gamma reference voltage generating circuit comprises a first gamma reference voltage generating module and a second gamma reference voltage generating module. The first gamma reference voltage generating module is configured to receive a source voltage signal, amplify the source voltage signal to obtain a first gamma reference voltage signal, and output the first gamma reference voltage signal to a source driving circuit. The second gamma reference voltage generating module is configured to receive the source voltage signal, step down the source voltage signal to obtain a second gamma reference voltage signal, and divide a current on the second gamma reference voltage generating module into two output currents and transmit the two output currents to the source driving circuit, or buck chop the (Continued)

source voltage signal to obtain the second gamma reference voltage signal and transmit the second gamma reference voltage signal to the source driving circuit.

7 Claims, 3 Drawing Sheets

GAMMA REFERENCE VOLTAGE GENERATING CIRCUIT, LIQUID CRYSTAL DISPLAY PANEL DRIVING CIRCUIT AND METHOD THEREOF

RELATED APPLICATIONS

The present application is a National Phase of International Application Number PCT/CN2018/071383, filed on Jan. 4, 2018, and claims the priority of China Application No. 201711483122.0, filed on Dec. 29, 2017.

FIELD OF THE DISCLOSURE

The disclosure relates to a display technical field, and more particularly to a gamma reference voltage generating circuit, liquid crystal display panel driving circuit and method thereof.

BACKGROUND

In a liquid crystal display panel, a gate driving signal is transmitted through a scan line to a sub-pixel connected to the scan line for turning on the sub-pixel, a data voltage signal is transmitted to the sub-pixel through a data line to the sub-pixel connected to the data line for driving the sub-pixel to control deflection of liquid crystal in the sub-pixel, and the brightness of the liquid crystal display panel is controlled through controlling deflection angle of the liquid crystal.

A gamma reference voltage is generated in the liquid crystal display panel through a gamma reference voltage generating circuit, and is transmitted to a source driver integrated-circuit (IC). The source driver IC generates the data voltage signal in accordance with the gamma reference voltage and outputs the data voltage signal to the data line. The data voltage signal is output to each sub-pixel through the data line to control the brightness of each sub-pixel.

When a V-strip frame (i.e., a frame for illustrating a plurality of white lines and black lines arranged at intervals) is displayed on the liquid crystal display panel, a source voltage signal is amplified to obtain a first gamma reference voltage signal through an amplifier, and the source voltage signal is inverse-amplified to obtain a second gamma reference voltage signal through another amplifier. The source driver IC generates data voltage signal in accordance with the first gamma reference voltage signal and the second gamma reference voltage signal, and outputs the data voltage signal to the data line to control the brightness of the sub-pixels connected to the data line to be black or white.

In full high-definition (HD) liquid crystal display panel or ultra HD liquid crystal display panel, the loading current on the second gamma reference voltage is great. The loading current in the full HD liquid crystal display panel could reach 256 mA so that the power consumption of the liquid crystal display panel is great, heat generated by the liquid crystal display panel is great, and the lifetime of the liquid crystal display panel is reduced.

SUMMARY

In order to solve the technique issues above, the present disclosure provides a gamma reference voltage generating circuit, liquid crystal display panel driving circuit and method thereof to reduce the loading current on the second gamma reference voltage and the power consumption of the liquid crystal display panel.

The present disclosure provides a gamma reference voltage generating circuit applied in a liquid crystal display panel, wherein the gamma reference voltage generating circuit comprises a first gamma reference voltage generating module and a second gamma reference voltage generating module;

the first gamma reference voltage generating module is configured to receive a source voltage signal from the liquid crystal display panel, amplify the source voltage signal to obtain a first gamma reference voltage signal, and output the first gamma reference voltage signal to a source driving circuit of the liquid crystal display panel; the second gamma reference voltage generating module is configured to receive the source voltage signal from the liquid crystal display panel, step down the source voltage signal to obtain a second gamma reference voltage signal, and divide a current on the second gamma reference voltage generating module into two output currents and transmit the two output currents to the source driving circuit through different two paths, or buck chop the source voltage signal to obtain the second gamma reference voltage signal and transmit the second gamma reference voltage signal to the source driving circuit.

In one embodiment, the second gamma reference voltage generating module comprises two inverse amplifiers;

input terminals of the two inverse amplifiers are connected together to receive the source voltage signal, each of the two inverse amplifiers is used for inverse-amplifying the source voltage signal to obtain the second gamma reference voltage signal, and the obtained two second gamma reference voltage signals are output to different signal input terminals of the source driving circuit.

In one embodiment, a plurality of positive input terminals of the two inverse amplifiers are connected together to receive the source voltage signal;

a plurality of negative input terminals of the two inverse amplifiers are connected together to receive a reference voltage signal, and an output terminal of each of the two inverse amplifiers outputs the second gamma reference voltage signal.

In one embodiment, a voltage value of the first gamma reference voltage signal is twice a voltage value of the second gamma reference voltage signal.

In one embodiment, the second gamma reference voltage generating module is a BUCK circuit being capable of pulling current;

a voltage value of the first gamma reference voltage signal is ranged from 15V to 18V.

The present disclosure further provides a liquid crystal display panel driving circuit, comprising a gamma reference voltage generating circuit and a source driving circuit; wherein the gamma reference voltage generating circuit comprises a first gamma reference voltage generating module and a second gamma reference voltage generating module;

the first gamma reference voltage generating module is configured to receive a source voltage signal from the liquid crystal display panel, amplify the source voltage signal to obtain a first gamma reference voltage signal, and output the first gamma reference voltage signal to a source driving circuit of the liquid crystal display panel;

the second gamma reference voltage generating module is configured to receive the source voltage signal from the liquid crystal display panel, step down the source voltage signal to obtain a second gamma reference voltage signal, and divide a current on the second gamma reference voltage generating module into two output currents and transmit the two output currents to the source driving circuit via different two paths, or buck chop the source voltage signal to obtain the second gamma reference voltage signal and transmit the second gamma reference voltage signal to the source driving circuit;

the source driving circuit is connected to a plurality of data lines of the liquid crystal display panel to generate a positive data voltage signal and a negative data voltage signal in accordance with the first gamma reference voltage signal and the second gamma reference voltage signal and transmit the positive data voltage signal and the negative data voltage signal to different one of the data lines, respectively;

wherein, a voltage value of the positive data voltage signal is between a voltage value of the first gamma reference voltage signal and a voltage value of the second gamma reference voltage signal, and a voltage value of the negative data voltage signal is between the voltage value of the second gamma reference voltage signal and 0.

In one embodiment, the source driving circuit outputs the positive data voltage signal and the negative data voltage signal to the data lines, a polarity of data voltage signal on a selected one of the data lines is inverse to a polarity of data voltage signal on one of the data lines adjacent to the selected data line.

In one embodiment, the second gamma reference voltage generating module comprises two inverse amplifiers;

input terminals of the two inverse amplifiers are connected together to receive the source voltage signal, each of the two inverse amplifiers is used for inverse-amplifying the source voltage signal to obtain the second gamma reference voltage signal, and the obtained two second gamma reference voltage signals are output to different signal input terminals of the source driving circuit.

In one embodiment, a plurality of positive input terminals of the two inverse amplifiers are connected together to receive the source voltage signal;

a plurality of negative input terminals of the two inverse amplifiers are connected together to receive a reference voltage signal, and an output terminal of each of the two inverse amplifiers outputs the second gamma reference voltage signal.

In one embodiment, the voltage value of the first gamma reference voltage signal is twice the voltage value of the second gamma reference voltage signal.

In one embodiment, the second gamma reference voltage generating module is a BUCK circuit being capable of pulling current;

the voltage value of the first gamma reference voltage signal is ranged from 15V to 18V.

The present disclosure further provides a liquid crystal display panel driving method, comprising steps of:

receiving a source voltage signal, amplifying the source voltage signal to obtain a first gamma reference voltage signal, and outputting the first gamma reference voltage signal to a source driving circuit;

receiving the source voltage signal, stepping down the source voltage signal to obtain a second gamma reference voltage signal, and dividing a current corresponding to the second gamma reference voltage signal into two output currents and transmitting the two output currents to the source driving circuit through different two paths, or buck chopping the source voltage signal to obtain the second gamma reference voltage signal and transmitting the second gamma reference voltage signal to the source driving circuit.

In one embodiment, a voltage value of the first gamma reference voltage signal is twice a voltage value of the second gamma reference voltage signal.

In one embodiment, the liquid crystal display panel driving method further comprises steps of:

generating a positive data voltage signal and a negative data voltage signal by the source driving circuit in accordance with the first gamma reference voltage signal and the second gamma reference voltage signal, and transmitting the positive data voltage signal and the negative data voltage signal to a plurality of data lines so that a polarity of data voltage signal on a selected one of the data lines is inverse to a polarity of data voltage signal on one of the data lines adjacent to the selected data line.

The beneficial effects of performing the present disclosure are as follows: the present disclosure reduces the currents on data line through dividing the current generated by the second gamma reference voltage generating module into two output currents and outputting the two output currents to the source driving circuit through different two paths, or reduces the currents output from the source driving circuit to the data lines through buck chopping the current output to the source driving circuit, so that the loading on the second gamma reference voltage signal is reduced. Therefore, loading current of the second gamma reference voltage signal, consumption of the liquid crystal display panel and heat dissipation of the liquid crystal display panel are reduced.

BRIEF DESCRIPTION OF THE DRAWINGS

In order to make the descriptions of the technique solutions of the embodiments of the present invention or the existed techniques, the drawings necessary for describing the embodiments or the existed techniques are briefly introduced below. Obviously, the drawings described below are only some embodiments of the present invention, and, for those with ordinary skill in this field, other drawings can be obtained from the drawings described below without creative efforts.

DETAILED DESCRIPTION OF PREFERRED EMBODIMENTS

Figure 1:
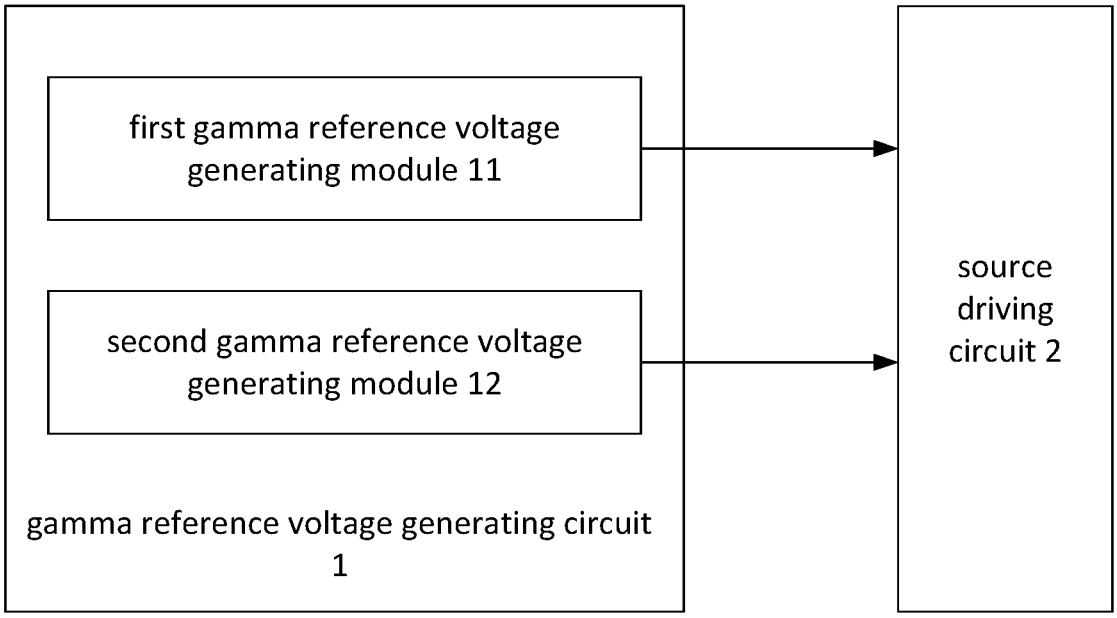
FIG. 1 is a schematic block diagram of the liquid crystal display panel driving circuit provided by the present disclosure.

The present disclosure provides a gamma reference voltage generating circuit applied in a liquid crystal display panel. As shown in FIG. 1, the gamma reference voltage generating circuit 1 comprises a first gamma reference voltage generating module 11 and a second gamma reference voltage generating module 12.

The first gamma reference voltage generating module 11 is configured to receive a source voltage signal from the liquid crystal display panel, amplify the source voltage signal to obtain a first gamma reference voltage signal, and output the first gamma reference voltage signal to a source driving circuit 2 of the liquid crystal display panel.

The second gamma reference voltage generating module 12 is configured to receive the source voltage signal from the liquid crystal display panel, step down the source voltage signal to obtain a second gamma reference voltage signal, and divide a current on the second gamma reference voltage generating module 12 into two output currents and transmit the two output currents to the source driving circuit 2 through different two paths, or buck chop the source voltage signal to obtain the second gamma reference voltage signal and transmit the second gamma reference voltage signal to the source driving circuit 2.

Figure 2:
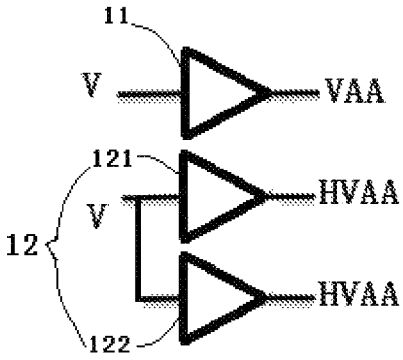
FIG. 2 is a schematic diagram of the first gamma reference voltage generating module and the second gamma reference voltage generating module provided by the present disclosure.

In one embodiment, as shown in FIG. 2, the second gamma reference voltage generating module 12 comprises two inverse amplifiers 121 and 122. The input terminals of the two inverse amplifiers 121 and 122 are connected together to receive the source voltage signal V, each of the two inverse amplifiers 121 and 122 is used for inverse-amplifying the source voltage signal V to obtain the second gamma reference voltage signal HVAA, and the obtained two second gamma reference voltage signals HVAA are output to different signal input terminals of the source driving circuit 2. The first gamma reference voltage generating module 11 is also an amplifier, and the amplifier amplifies the source voltage signal V to obtain the first gamma reference voltage signal VAA and outputs the first gamma reference voltage signal VAA. Generally, the voltage value of the source voltage signal is 12V or about 12V.

In one embodiment, a plurality of positive input terminals of the two inverse amplifiers 121 and 122 are connected together to receive the source voltage signal, a plurality of negative input terminals of the two inverse amplifiers 121 and 122 are connected together to receive a reference voltage signal, and an output terminal of each of the two inverse amplifiers 121 and 122 outputs the second gamma reference voltage signal, respectively. Each of the two inverse amplifiers 121 and 122 performs a difference operation on the voltage signals on the positive input terminal and the second input terminal, and then proceeds other operations on the difference result of the voltage signals to obtain the second gamma reference voltage signal.

In one embodiment, the voltage value of the first gamma reference voltage signal is twice the voltage value of the second gamma reference voltage signal.

In one embodiment, the second gamma reference voltage generating module 12 is a BUCK circuit (i.e., buck chop circuit) being capable of pulling current.

In one embodiment, the voltage value of the first gamma reference voltage signal is ranged from 15V to 18V. Specifically, the voltage value of the first gamma reference voltage signal is 16V or 18V.

The present disclosure further provides a liquid crystal display panel driving circuit. As shown in FIG. 1, the driving circuit comprisies the gamma reference voltage generating circuit 1 and source driving circuit 2 described above.

The source driving circuit 2 is connected to the data lines of the liquid crystal display panel, configured to generating a positive data voltage signal and a negative data voltage signal in accordance with the received first gamma reference voltage signal and the second gamma reference voltage signal, and configured to output the positive data voltage signal and the negative data voltage signal to different data lines, respectively.

In one embodiment, the voltage value of the positive data voltage signal is between the voltage value of the first gamma reference voltage signal and the voltage value of the second gamma reference voltage signal, and the voltage value of the negative data voltage signal is between the voltage value of the second gamma reference voltage signal and 0.

A plurality of gamma reference voltage signal input terminals are set onto the source driving circuit 2. The source driving circuit 2 generates data voltage signals in accordance with the gamma reference voltage signals received from the input terminals, and outputs the data voltage signals to the data lines to control the brightness of the sub-pixels connected to the data lines. When two second gamma reference voltage signals transmitted from the second gamma reference voltage generating module 12 and through different two paths are received by two different input terminals on the source driving circuit 2, the source driving circuit 12 generates a first data voltage signal in accordance with the first gamma reference voltage signal and the second gamma reference voltage signal transmitted from a first one of the different two paths and outputs the first data voltage signal to a first part of the data lines, and further generates a second data voltage signal in accordance with the first gamma reference voltage signal and the second gamma reference voltage signal transmitted from a second one of the different two paths and outputs the second data voltage signal to a second part of the data lines. Wherein, all data lines of the liquid crystal display panel are composed of the first part and the second part of the data lines. The first data voltage signal and the second data voltage signal could both comprise the positive data voltage signal and the negative data voltage signal.

In one embodiment, when the source driving circuit 2 outputs the positive data voltage signal and the negative data voltage signal to the data lines, a polarity of data voltage signal on a selected one of the data lines is inverse to a polarity of data voltage signal on one of the data lines adjacent to the selected data line.

The liquid crystal display panel in the present disclosure comprises a plurality of sub-pixels arranged in matrix, a plurality of data lines arranged in interval parallelly and a plurality of scan lines arranged in interval parallelly, wherein the scan lines are configured to turn on the sub-pixels.

Figure 3:
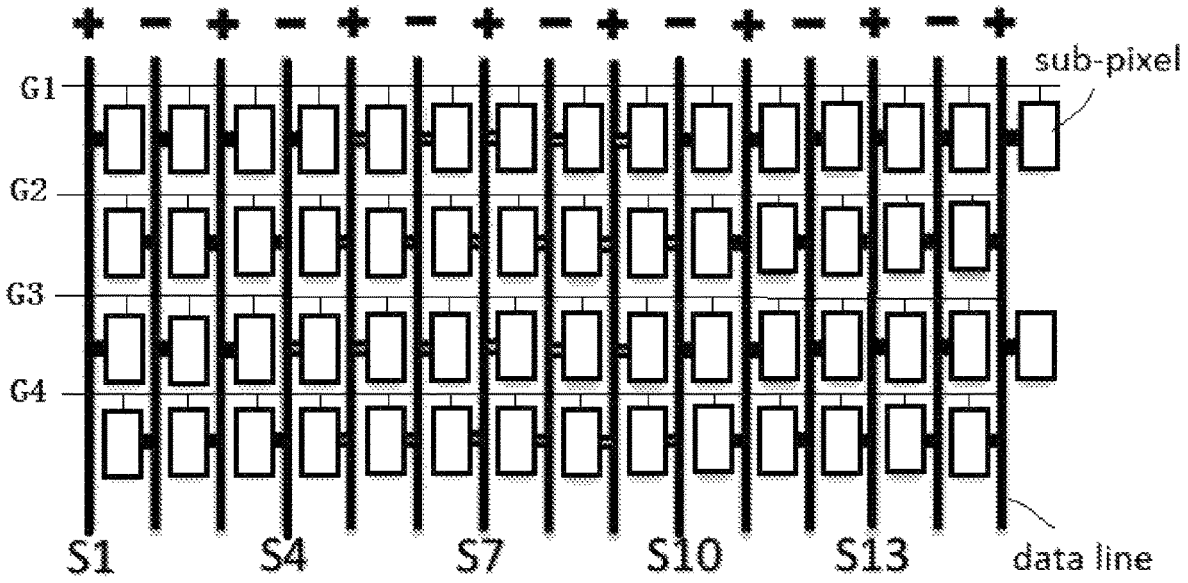
FIG. 3 is a schematic diagram of the pixel structure in the liquid crystal display panel provided by the present disclosure.
Figure 4:
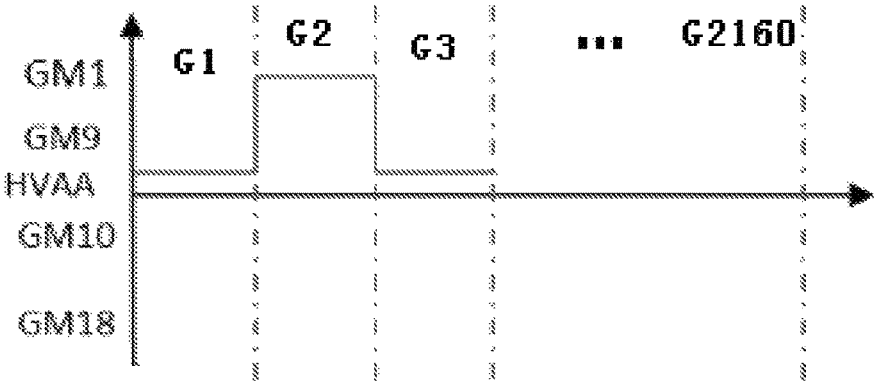
FIG. 4 is a schematic diagram showing corresponding relationship between the data voltage on the data line S7 in FIG. 3 and the sub-pixels connected to each scan line being turned on in the first embodiment provided by the present disclosure.

In a first embodiment, as shown in FIG. 3, the polarities of the data voltage signals on the data lines, in the sequence from left side to right side of the figure, are positive (+) and negative (−) arranged in intervals beginning with the first data line S1 in the left side of the data lines. Taken the data line S7 as an example, the gamma reference voltages of the liquid crystal display panel are denoted, from large to small and equally spaced, as GM1, GM2, GM3, . . . . . , GM18, wherein GM1 is corresponding to the voltage value of the first gamma reference voltage signal, GM18 is 0, and the voltage value of the second gamma reference voltage signal HVAA is between GM9 and GM10. As shown in FIG. 4, when there is the positive data voltage on the data line S7, the data voltage on the data line S7 is about GM1 when the scan line G2 turns on the sub-pixel connected to the scan line G2, and the data voltage on the data line S7 is less than GM9 when the scan lines G1 and G3 are turned on.

It can be found in FIG. 3 that each sub-pixel between the data line S4 and the data line S10 is connected to the corresponded data line through two connection wires, the corresponded data line could output different data voltage signals to the corresponded sub-pixel through the two connection wires, so that the sub-pixels connected to the same data line could display a white color and a black color to prevent the black lines from getting wider due to simultaneously displaying only one of the white color and the black color by the sub-pixels connected to the same data line. Therefore, the pixel structure shown in FIG. 3 could be applied in ultra high-definition (HD) display panel.

When the sub-pixels connected to the data line S7 become bright from dark, the data line S7 performs pull-loading on the first gamma reference voltage signal VAA, that is, the first gamma reference voltage generating module 11 outputs a pull current to the data line S7. On the contrary, when the sub-pixels connected to the data line S7 become dark from bright, the data line S7 performs push-loading on the second gamma reference voltage generating module 12, that is, the data line S7 outputs a push current to the second gamma reference voltage generating module 12, and, at this time, the second gamma reference voltage generating module 12 is in a current-pulling status and lasts for about 16.7 ms.

Figure 5A:
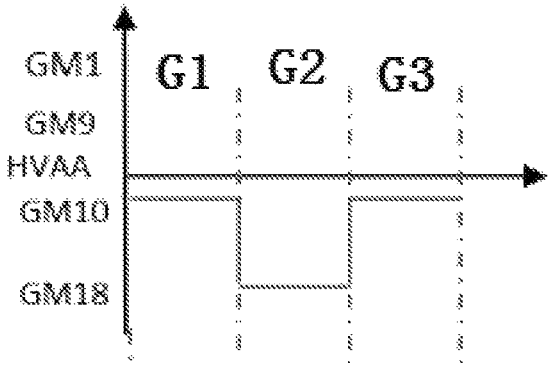
FIG. 5*a* is a schematic diagram showing corresponding relationship between the data voltage on the data line S4 in FIG. 3 and the sub-pixels connected to each scan line being turned on in the second embodiment provided by the present disclosure.

In a second embodiment, as shown in FIG. 5*a*, when the scan lines G1 and G3 turn on the sub-pixels connected correspondingly thereto, the data voltage on the data line S4 is about GM10, and, when the scan line G2 turns on the sub-pixels connected correspondingly thereto, the data voltage on the data line S4 is about GM18. At this situation, there is the negative data voltage signal on the data line S4, and, when line scan is performed, the second gamma reference voltage signal HVAA is pulled and discharged to ground.

Figure 5B:
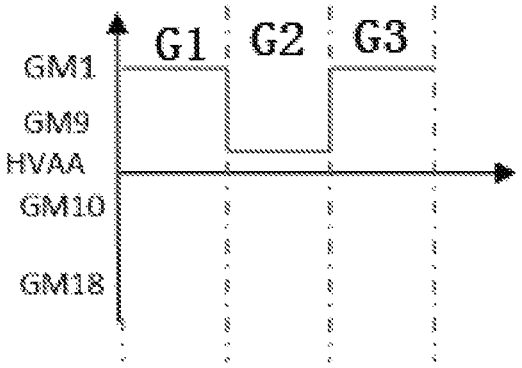
FIG. 5*b* is a schematic diagram showing corresponding relationship between the data voltage on the data line S7 in FIG. 3 and the sub-pixels connected to each scan line being turned on in the second embodiment provided by the present disclosure.

As shown in FIG. 5*b*, when the scan lines G1 and G3 turn on the sub-pixels connected correspondingly thereto, the data voltage on the data line S7 is about GM1, and, when the scan line G2 is turned on, the data voltage on the data line S7 is less than GM9. At this situation, there is the positive data voltage signal on the data line S7, and the data line S7 performs pull-loading on the first gamma reference voltage signal VAA and performs push-loading on the second gamma reference voltage signal HVAA. Therefore, pull-loading and push-loading on the second gamma reference voltage signal are performed basically at the same time so that balance is reached, utilization is high, and loading is small. Of course, when the polarity of the data voltage signal on the scan line is inverted, the pull-loading on the second gamma reference voltage signal is still small.

In a full HD display panel, the sub-pixels connected to the data lines between the data line S1 and S7 (do not include the data line S1 and S7) are always bright, and the sub-pixels connected to the data lines between the data line S7 and S13 (do not include the data line S7 and S13) are always dark. Therefore, the potentials of the data lines to which the sub-pixels being always bright or dark are connected are kept constant basically, and the current pulled from the second gamma reference voltage signal HVAA is small, i.e., the pull-loading on the second gamma reference voltage signal HVAA is small.

The present disclosure further provides a liquid crystal display panel driving method, comprising steps of:

receiving the source voltage signal, amplifying the source voltage signal to obtain the first gamma reference voltage signal, and outputting the first gamma reference voltage signal to the source driving circuit 2;

receiving the source voltage signal, stepping down the source voltage signal to obtain the second gamma reference voltage signal, and dividing the current corresponding to the second gamma reference voltage signal into two output currents and transmitting the two output currents to the source driving circuit 2 through different two paths, or buck chopping the source voltage signal to obtain the second gamma reference voltage signal and transmitting the second gamma reference voltage signal to the source driving circuit 2.

In one embodiment, the voltage value of the first gamma reference voltage signal is twice the voltage value of the second gamma reference voltage signal.

In one embodiment, the liquid crystal display panel driving method further comprises steps of:

generating a positive data voltage signal and a negative data voltage signal by the source driving circuit 2 in accordance with the first gamma reference voltage signal and the second gamma reference voltage signal, and transmitting the positive data voltage signal and the negative data voltage signal to the data lines so that the polarities of the data voltage signals on adjacent data lines are inverted.

In summary, the present disclosure reduces the currents on data line through dividing the current generated by the second gamma reference voltage generating module 12 into two output currents and outputting the two output currents to the source driving circuit 2 through different two paths, or reduces the currents output from the source driving circuit 2 to the data lines by buck chopping the current output to the source driving circuit 2, so that the loading on the second gamma reference voltage signal is reduced. Therefore, loading current of the second gamma reference voltage signal, consumption of the liquid crystal display panel and heat dissipation of the liquid crystal display panel are reduced.

The foregoing contents are detailed description of the disclosure in conjunction with specific preferred embodiments and concrete embodiments of the disclosure are not limited to the description. For the person skilled in the art of the disclosure, without departing from the concept of the disclosure, simple deductions or substitutions can be made and should be included in the protection scope of the application.

What is claimed is:

1. A gamma reference voltage generating circuit applied in a liquid crystal display panel, wherein the gamma reference voltage generating circuit comprises a first gamma reference voltage generating module and a second gamma reference voltage generating module;

the first gamma reference voltage generating module is configured to receive a source voltage signal from the liquid crystal display panel, use an amplifier to amplify the source voltage signal to obtain a first gamma reference voltage signal, and output the first gamma reference voltage signal to a source driving circuit of the liquid crystal display panel;

the second gamma reference voltage generating module is configured to receive the source voltage signal from the liquid crystal display panel through two inverse amplifiers, use the two inverse amplifiers to inverse-amplify the source voltage signal to obtain two second gamma reference voltage signals and divide a current on the second gamma reference voltage generating module into two output currents, and transmit the two output currents to the source driving circuit through different two paths;

wherein input terminals of the two inverse amplifiers are connected together to receive the source voltage signal, and the obtained two second gamma reference voltage signals are output to different signal input terminals of the source driving circuit wherein a plurality of positive input terminals of the two inverse amplifiers are connected together to receive the source voltage signal;

wherein a plurality of negative input terminals of the two inverse amplifiers are connected together to receive a reference voltage signal, and an output terminal of each of the two inverse amplifiers outputs the second gamma reference voltage signal.

2. The gamma reference voltage generating circuit according to claim 1, wherein a voltage value of the first gamma reference voltage signal is twice a voltage value of the second gamma reference voltage signal.

3. . The gamma reference voltage generating circuit according to claim 1, wherein the second gamma reference voltage generating module is a BUCK circuit being capable of pulling current;

a voltage value of the first gamma reference voltage signal is ranged from 15V to 18V.

4. A liquid crystal display panel driving circuit, comprising a gamma reference voltage generating circuit and a source driving circuit; wherein the gamma reference voltage generating circuit comprises a first gamma reference voltage generating module and a second gamma reference voltage generating module;

the first gamma reference voltage generating module is configured to receive a source voltage signal from the liquid crystal display panel, use an amplifier to amplify the source voltage signal to obtain a first gamma reference voltage signal, and output the first gamma reference voltage signal to a source driving circuit of the liquid crystal display panel;

the second gamma reference voltage generating module is configured to receive the source voltage signal from the liquid crystal display panel through two inverse amplifiers, use the two inverse amplifiers to inverse-amplify the source voltage signal to obtain two second gamma reference voltage signal and divide a current on the second gamma reference voltage generating module into two output currents, and transmit the two output currents to the source driving circuit via different two paths;

the source driving circuit is connected to a plurality of data lines of the liquid crystal display panel to generate a positive data voltage signal and a negative data voltage signal in accordance with the first gamma reference voltage signal and the two second gamma reference voltage signals and transmit the positive data voltage signal and the negative data voltage signal to different one of the data lines, respectively;

wherein, a voltage value of the positive data voltage signal is between a voltage value of the first gamma reference voltage signal and a voltage value of the second gamma reference voltage signal, and a voltage value of the negative data voltage signal is between the voltage value of the second gamma reference voltage signal and 0;

wherein input terminals of the two inverse amplifiers are connected together to receive the source voltage signal, and the obtained two second gamma reference voltage signals are output to different signal input terminals of the source driving circuit; wherein a plurality of positive input terminals of the two inverse amplifiers are connected together to receive the source voltage signal;

wherein a plurality of negative input terminals of the two inverse amplifiers are connected together to receive a reference voltage signal, and an output terminal of each of the two inverse amplifiers outputs the second gamma reference voltage signal.

5. The liquid crystal display panel driving circuit according to claim 4, wherein, when the source driving circuit outputs the positive data voltage signal and the negative data voltage signal to the data lines, a polarity of data voltage signal on a selected one of the data lines is inverse to a polarity of data voltage signal on one of the data lines adjacent to the selected data line.

6. . The liquid crystal display panel driving circuit according to claim 4, wherein the voltage value of the first gamma reference voltage signal is twice the voltage value of the second gamma reference voltage signal.

7. The liquid crystal display panel driving circuit according to claim 4, wherein the second gamma reference voltage generating module is a BUCK circuit being capable of pulling current;

the voltage value of the first gamma reference voltage signal is ranged from 15V to 18V.

* * * * *